US009299326B1

(12) United States Patent
Tomczak

(10) Patent No.: US 9,299,326 B1
(45) Date of Patent: Mar. 29, 2016

(54) MULTIPLE STRING TREMOLO ASSEMBLY

(71) Applicant: Brian A. Tomczak, Orland Hills, IL (US)

(72) Inventor: Brian A. Tomczak, Orland Hills, IL (US)

( * ) Notice: Subject to any disclaimer, the term of this patent is extended or adjusted under 35 U.S.C. 154(b) by 0 days.

(21) Appl. No.: 14/600,482

(22) Filed: Jan. 20, 2015

(51) Int. Cl.
*G10D 3/14* (2006.01)

(52) U.S. Cl.
CPC ..... *G10D 3/146* (2013.01)

(58) Field of Classification Search
CPC ..... G10D 3/146; G10D 3/14; G10D 1/00
USPC ..... 84/290, 313
See application file for complete search history.

(56) References Cited

U.S. PATENT DOCUMENTS 1,596,376 A * 8/1926 Roehrig ..... 369/218
2014/0202308 A1* 7/2014 Maslarov ..... 84/313

* cited by examiner

*Primary Examiner* — Kimberly Lockett

(57) ABSTRACT

A tremolo assembly for either a left handed as well as a right handed stringed instrument that sits wholly on top of the instrument. The tremolo assembly consists of in addition to the base mounting plate, an adjustable spring tension block, extension springs, a string anchor bar, a cross member attachment bar, eyebolts, hex nuts, flat head machine screws, shoulder screws, flat washers, set screws, adhesive backed felt, and a tremolo arm. The assembly pivots back and forth in relation to the base mounting plate. The extension springs and the adjustable spring anchor/tension block, hold the strings in a neutral (tuned) position. When the tremolo arm is pressed towards the instrument, the tension is decreased evenly across the plurality of strings. And when the tremolo arm is lifted away from the instrument, the tension is increased evenly across the plurality of strings.

3 Claims, 5 Drawing Sheets

MULTIPLE STRING TREMOLO ASSEMBLY

BACKGROUND

Prior Art

The following is a tabulation of some prior art that presently appears relevant:

U.S. Patents

| Patent Number | Kind Code | Issue Date | Patentee |
|---|---|---|---|
| 7,459,619 | B2 | Dec. 2, 2008 | Gawenda |
| 2012/0132055 | A1 | May 31, 2012 | Brinkley, Jr. |
| 7,772,470 | B1 | Aug. 10, 2010 | Olsen |
| 5,392,680 | A1 | Feb. 28, 1995 | Stets |
| 3,124,991 | A1 | Mar. 17, 1964 | Costen |
| 3,500,711 | A1 | Mar. 17, 1970 | Fender |
| 4,457,201 | A1 | Jul. 3, 1984 | Storey |
| 4,512,232 | A1 | Apr. 23, 1985 | Schaller |
| 4,608,905 | A1 | Sep. 2, 1986 | Takabayashi |
| 4,656,915 | A1 | Apr. 14, 1987 | Osuga |
| 4,944,208 | A1 | Jul. 31, 1990 | Kusek |
| 5,429,028 | A1 | Jul. 4, 1995 | Fisher IV |
| 5,477,765 | A1 | Dec. 26, 1995 | Dietzman |
| 5,481,955 | A1 | Jan. 9, 1996 | Goto |
| 5,520,082 | A1 | May 28, 1996 | Armstrong et al. |
| 5,986,190 | A1 | Nov. 16, 1999 | Wolff et al. |
| 6,384,311 | B1 | May 7, 2002 | Cota |
| 6,420,639 | B1 | Jul. 16, 2002 | Sherlock |
| 6,875,911 | B2 | Apr. 5, 2005 | Schryer |

BACKGROUND OF THE INVENTION

Guitar players and musical instrument resellers have had to buy/sell aftermarket, third party tremolo devices to add a vibrato effect to an existing instrument. Originally these devices were factory installed, and required a high skill level to properly integrate on an instrument. Several devices have evolved over the years, yet none have been able to be used for left handed instruments as well as right handed ones. This required the need for a special manufacturing of a left-handed model. Another disadvantage to these past devices is the need to alter or modify the instrument to accommodate installation. This can drastically affect the value of an instrument, especially if it is rare or vintage. And after installation of one of these devices, if it is desired to return the instrument back to its original configuration, you had to have it professionally restored. These become in essence permanent non-removable devices.

Over the years, various designs of tremolo assemblies have been employed, such as, the Bigsby® vibrato tailpiece, the Fender® synchronized tremolo, Fender® floating bridge, Fender® Dynamic Vibrato, Gibson® Vibrola, the Floyd Rose® locking tremolo, the Stets bar, and the SchallerTremelo LP. While these designs have enjoyed varying degrees of success and popularity among musicians, some of these designs require significant accommodations or modifications to the body of the instrument, such as, routing a shallow relief in the front face of the body, or creating a cavity in the rear of the body with through access to the top of the instrument. Other replacement systems may require the replacement of the original bridge. With significant modifications and the permanence of such installations, these prior assemblies are typically factory installed, and may require professional setup and intonation after installation.

All the Here to Fore Devices Suffer from a Number of Disadvantages:

(a) They require separate models to be produced for left and right-handed instruments, often a special order for left handed models.

(b) They cannot be installed or removed without altering or modifying the instrument. Once installed said instrument cannot be reconfigured to original condition by removing said device. Expensive restoration would be required.

(c) They require a secondary point on the instrument for spring attachment, thus not a self-contained unit.

(d) Adjusting tension of the springs requires removing an access plate, often on the back of the instrument.

(e) Can only be attached and removed from the instrument without modifications, by means of the addition of a third party adapter plate. Adding additional cost.

SUMMARY

This device provides a tremolo assembly for Instruments, which utilize a hard tail string anchoring system. For installation without modifying or altering the Instrument, whereas this unit replaces the stop tailpiece, and bolts to the guitar in it's place. The unit thus provides the means to affect the tuning/pitch of the strings while the Instrument is being played. The guitar can be returned to the original configuration by reinstalling the removed parts, thus not affecting the value of the guitar. The same Tremolo assembly can be used for left handed or right handed guitars, without the need to manufacture a special device.

DESCRIPTION

A tremolo system that uses solid metal alloy materials, cut and machined to form the assembly. The metal alloy mounting plate 10, has the bottom surface covered in felt 22, allows attachment of the device to the instrument as well as the lever assembly and spring tension block plate 11, making up the tremolo assembly. The lever assembly consists of a main cross member bar 12 machined from solid metal alloy bar, that provides mounting of through a hole for the string anchor bar 13 to slide through, through holes for the tension springs eye-bolts 15 to mount to secured by hex nuts 16, and two threaded holes for the tremolo actuator bar 14. The spring tension block 11 is machined from solid metal alloy and allows for the extension springs 17, to be anchored and is attached by means of flathead machine screws 20, flat washers 19, and hex nuts 16 to the bass mounting plate 10, the spring tension block 11 allows for spring tension adjustments via set screws 21. The main cross bar 12, the string anchor bar 13 and the base mounting plate 10 are joined together using fasteners 18. The string anchor bar 13 is made from ¼" metal alloy bar stock, it is machined to accept the guitars strings passing through the bar, exiting the front of the device, and proceeding over the guitars bridge, up the neck of the guitar. The string anchor bar 13 rotates freely in its holes in the main cross bar 12.

DESCRIPTION OF THE DRAWINGS

Figures

In the accompanying drawings which form part of the specification.

DRAWINGS

Reference Numerals

| | |
|---|---|
| 10 mounting base plate | 11 spring block |
| 12 cross member bar | 13 string anchor bar |
| 14 tremolo activator bar | 15 eyebolt |
| 16 hex nut | 17 extension spring |
| 18 machine shoulder screw | 19 flat washer |
| 20 flathead machine screw | 21 set screw |
| 22 felt | |

DETAILED DESCRIPTION

Figure 1:
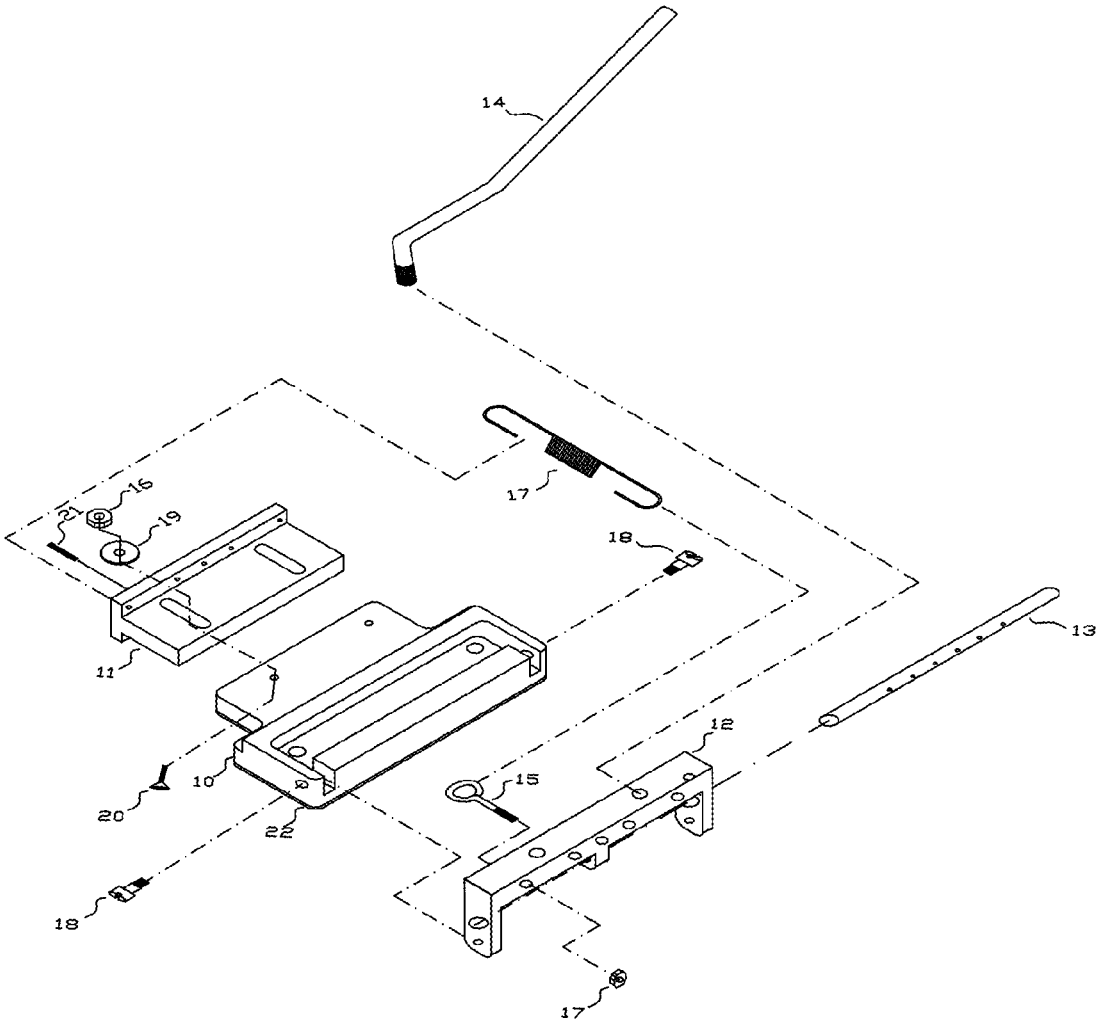
FIG. 1 shows an exploded isometric perspective view of the assembly.

FIG. 1—First Embodiment

One embodiment of the assembly depicts an exploded view of the device showing an improved tremolo capable of providing a vibrato effect in which the pitch can be raised and lowered for the plurality of strings. The assembly is shown with certain redundant detail omitted, i.e. multiple of extension springs 17, eyebolts 15, and hex nuts 16 (which can be used in different configurations in 3, 4, and 5 quantities). This self-contained surface mounted guitar tremolo device is disclosed, in the following description. Referring to FIG. 1, the base mounting plate 10 with an adhesive backed felt 22 on its bottom, mounts to the instrument via the guitars stop tailpiece mounts after said original equipment manufacturer part is removed. The string anchor bar 13 then slides into place thru the holes provided in the cross member bar 12. The assembly is then attached to the mounting plate 10 with two shoulder machine screws 18, into the tapped holes allowing the assembly to pivot axially between the neutral position and the vibrato effect positions. The adjustable spring anchor block 11 then attaches to the mounting plate 10 by means of two flathead machine screws 20, two flat washers 19, and two hex nuts 16. Two full threaded setscrews 21 thread into the backend of the spring anchor block 11 providing a means to adjust spring tension. Eyebolts 15 are then inserted into the thru holes of the cross member bar 12 and are secured by hex nuts 16. Extension springs 17 are then anchored to the spring tension block 11 and the eyebolts 15 providing the necessary force to counteract the pull of the tuned guitar stings. The tremolo activator bar 14 is removable and threads into one of the two holes provided in the cross member bar 12 depending on right or left handed configuration.

Figure 2:
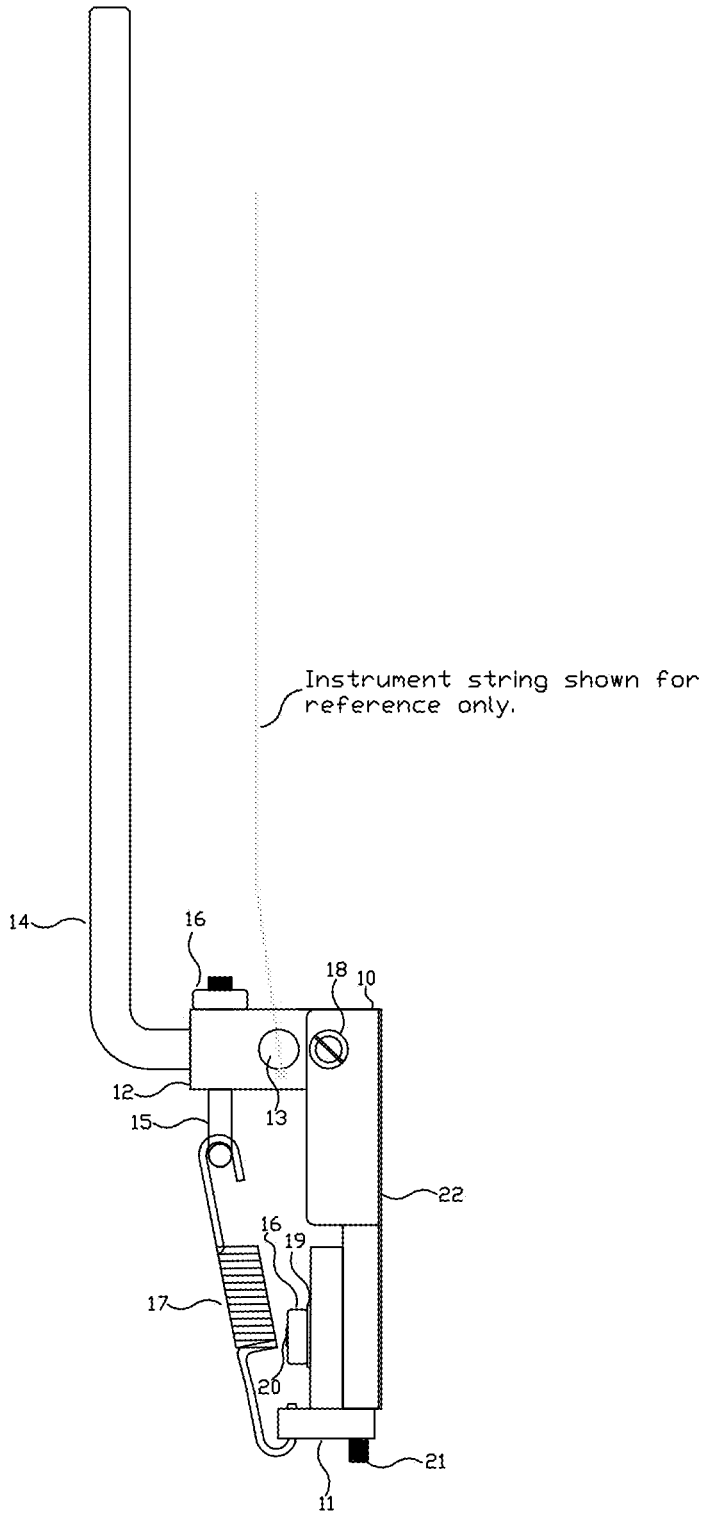
FIG. 2 shows an orthogonal engineering side view of the assembly.

FIG. 2 illustrates a side view of an alternate embodiment of the tremolo device. Showing the assembled device to provide additional clarity of the mechanism of the device. The two setscrews 21 are shown threaded into the tapped holes provided in the spring anchor block 11, where they push against the mounting plate 10 sliding the anchor block 11 away from said plate. This view better illustrates how the extension springs 17 connect to both the spring anchor block 11 and the eyebolts 15. The spring tension block 11 is connected to the mounting plate by two flathead machine screws 20, two flat washers 19, and two hex nuts 16. The felt 22 is attached to the bottom of the mounting plate 10 and encompasses the entire area except for the two thru holes for mounting purposes. The shoulder machine screws 18 pass thru holes in the mounting plate 10 and screw into the assembled cross member bar 12, string anchor bar 13 together. The eyebolts 15 pass thru the cross member bar 12 horizontally and are secured by hex nuts 16. The tremolo activator bar 14 is shown threaded into the top of the cross member bar 12.

Figure 3:
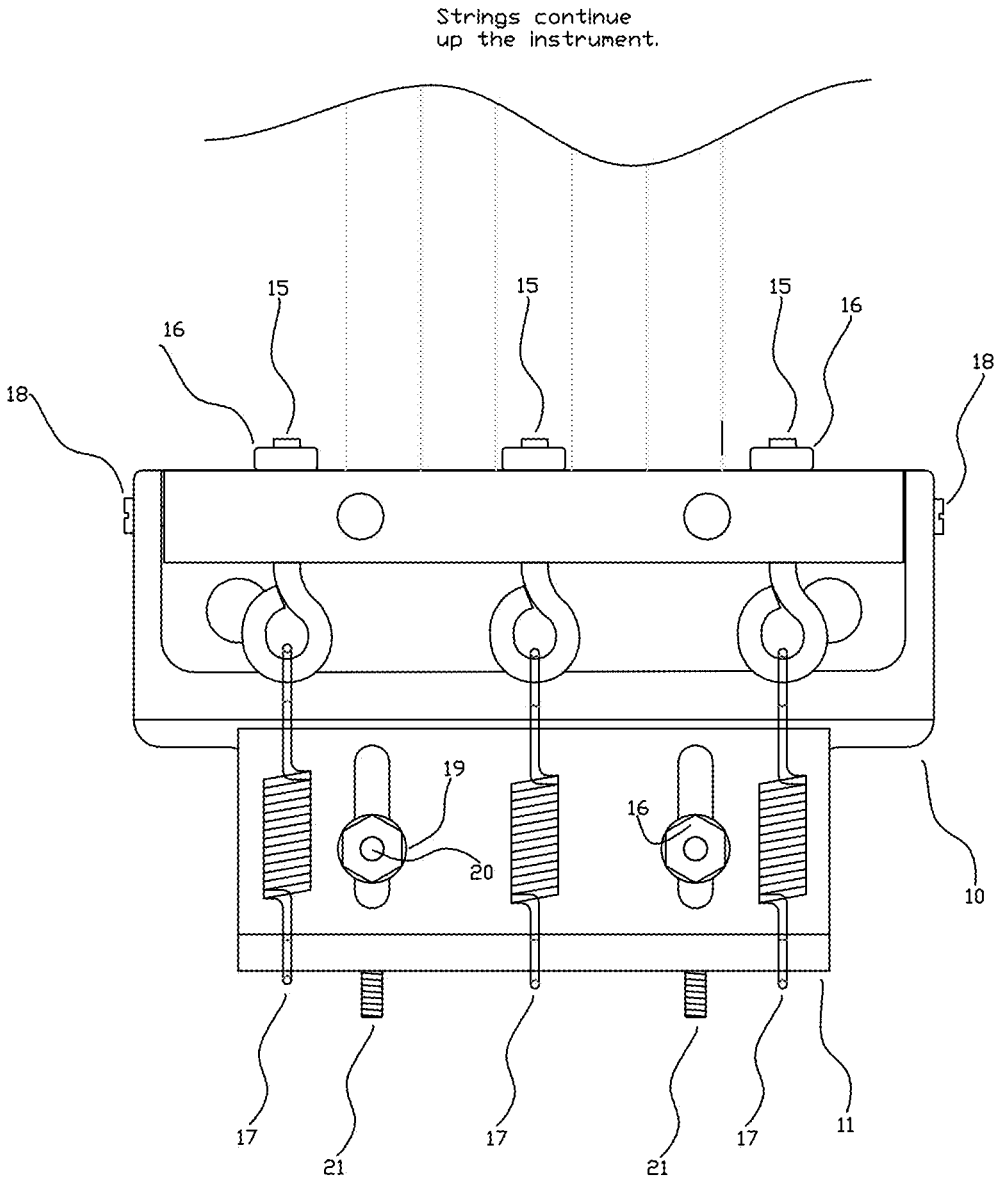
FIG. 3 shows an orthogonal engineering top view of the assembly.

FIG. 3 illustrates a top view of an alternate embodiment of the aforementioned device. Providing another view for clarity of the configuration of the assembled device. This view shows three extension springs 17 connected to the spring anchor block 11 and eyebolts 15 which are connected to the cross member bar 12 by means of hex nuts 16. The two setscrews 21 are shown threaded into the spring anchor block 11 and by turning said screws clock wise, the spring anchor block moves away from the mounting plate 10 providing added tension on the extension springs 17. The spring anchor block 11 has two slots machined into it to allow for travel back and forth, these slots provide a means for the spring anchor block 11 to be secured in place on the mounting plate 10 by means of two flathead machine screws 20, two flat washers 19, and two hex nuts 16. The two shoulder machine screws 18 provide a pivot point for the assembly of the cross member bar 12, the string anchor bar 13.

Figure 4:
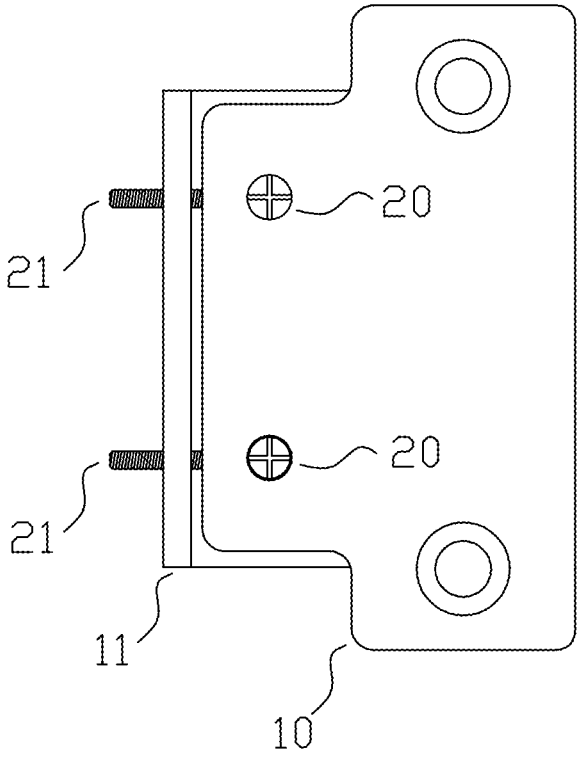
FIG. 4 shows an orthogonal engineering bottom view of the assembly.

FIG. 4 illustrates a bottom view of an alternate embodiment of the aforementioned assembly. Providing another view for clarity in which there is nothing below the felt on the base mounting plate that protrudes into the surface of the instrument. Shown here are the base mounting plate 10, the spring anchor block 11, the set screws 21, and the felt 22 on the bottom of the assembly.

Figure 5:
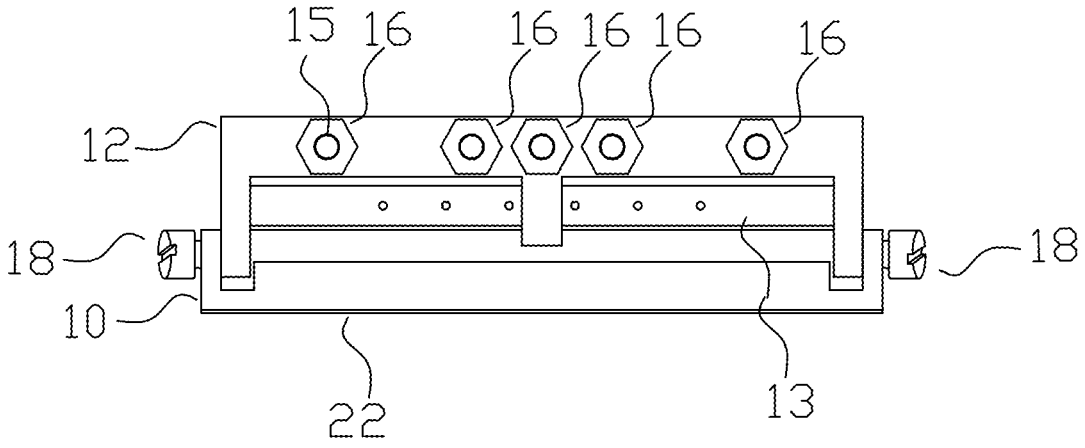
FIG. 5 shows an orthogonal engineering front view of the assembly.

FIG. 5 illustrates a front view of an alternate embodiment of the aforementioned Assembly. Showing how the assembly incorporates the plurality of strings. Shown here Is the base mounting plate 10, the cross member bar 12, the string anchor bar 13, the hex Nuts 16, the machined shoulder screws 18, and the felt 22.

ADVANTAGES

Accordingly several advantages of one or more aspects are as follows: the tremolo device mounts to the guitar body without any modification or removing of material from the guitar body, thus making it possible to replace the existing parts back on the instrument to restore it to its previous state without the need for costly repair work. The entire device is housed above the mounting plate with exception of the protective felt on the bottom of the mounting plate; this ensures protection to the finish of the instrument. The surface mounted aspect of the unit provides easy access to the spring tensioning adjustments, without the need to open up the guitar to gain access. The design of the mounting plate allows the device to be used for either left or right-handed guitars, no need for manufacturing a special version for left-handed guitars. Installation is quick and easy compared to other tremolo units, unstring the instrument, remove the hard tail stop and install the device in its place. Restring and tune the instrument. Adjust the spring tension and number of springs used based on the gage of strings used and the desired feel of the device.

I claim:

1. A tremolo device for a stringed instrument including a base plate, securely mounted to the instrument body, said instrument body having mounting points, said base plate is mounted on the instrument body at the same points on both left handed and right handed instruments, the base plate provides a means for attaching a cross member bar, using a shoulder screw on each side of the base plate, so that it pivots parallel to the strings of the instrument, the cross member bar accepts a tremolo activator bar in both the left handed and right handed positions, said cross member bar houses a string anchor bar, which provides an end point of the instruments strings, allowing the strings to continue up a neck of the instrument, said cross member bar also has mounting provisions for attachment of an extension spring, by means of an eye bolt and a nut, said extension spring connects to the base mounting plate through a spring anchor block, said spring anchor block is attached to the base mounting plate by means of a screw, a washer, and a nut to lock said spring anchor block in place.

2. A tremolo device for a stringed instrument according to claim 1, wherein the bottom surface of the base mounting plate is covered with a protective material, ensuring that the tremolo device is installed and removed so as to not damage the instrument bodies surface.

3. A tremolo device for a stringed instrument according to claim 1, wherein the extension springs are connected at both ends of the tremolo device, by means of the eye bolts that are connected to the cross member bar, and the other end of the extension spring is secured to the spring anchor block, thus encompassing a self contained assembly.

* * * * *